US009082381B2

(12) United States Patent
Barkley et al.

(10) Patent No.: US 9,082,381 B2
(45) Date of Patent: Jul. 14, 2015

(54) METHOD, SYSTEM, AND COMPUTER PROGRAM FOR ENABLING FLEXIBLE SOUND COMPOSITION UTILITIES

(71) Applicants: Scott Barkley, Toronto (CA); Charlie Macchia, Toronto (CA)

(72) Inventors: Scott Barkley, Toronto (CA); Charlie Macchia, Toronto (CA)

(73) Assignee: SCRATCHVOX INC., Toronto, Ontario (CA)

( * ) Notice: Subject to any disclaimer, the term of this patent is extended or adjusted under 35 U.S.C. 154(b) by 49 days.

(21) Appl. No.: 13/896,988

(22) Filed: May 17, 2013

(65) Prior Publication Data

US 2013/0305905 A1 Nov. 21, 2013

Related U.S. Application Data

(60) Provisional application No. 61/648,856, filed on May 18, 2012.

(51) Int. Cl.

| | |
|---|---|
| ***A63H 5/00*** | (2006.01) |
| ***G04B 13/00*** | (2006.01) |
| ***G10H 7/00*** | (2006.01) |
| ***G10H 1/00*** | (2006.01) |

(52) U.S. Cl.
CPC ..... *G10H 1/0025* (2013.01); *G10H 2220/126* (2013.01)

(58) Field of Classification Search
CPC ..... G06T 11/203; G10H 2220/126; G10H 1/0025; A01B 12/006
USPC ..... 84/622, 609
See application file for complete search history.

(56) References Cited

U.S. PATENT DOCUMENTS

| | | | | |
|---|---|---|---|---|
| 5,265,516 | A * | 11/1993 | Usa et al. | 84/600 |
| 5,331,111 | A * | 7/1994 | O'Connell | 84/602 |
| 5,744,742 | A * | 4/1998 | Lindemann et al. | 84/623 |
| 5,880,392 | A * | 3/1999 | Wessel et al. | 84/659 |
| 7,750,229 | B2 * | 7/2010 | Lindemann | 84/626 |
| 8,265,300 | B2 * | 9/2012 | Reid et al. | 381/104 |
| 8,809,663 | B2 * | 8/2014 | Risan | 84/602 |
| 2012/0174737 | A1 * | 7/2012 | Risan | 84/622 |
| 2014/0041511 | A1 * | 2/2014 | Kaipainen et al. | 84/465 |

* cited by examiner

*Primary Examiner* — Jeffrey Donels
(74) *Attorney, Agent, or Firm* — Norton Rose Fulbright Canada LLP

(57) ABSTRACT

A computer system for enabling generation/controlling/modification of sound elements is provided. A computer program defines a sound engine. The sound engine includes or is linked to one or more musical composition interfaces that enable one or more users to access a music generator/controller/modifier utility ("music generator"), so as to graphically map one or more musical notes by tracing one or more Bezier paths defined that are processable by the music generator so as to define the four fundamental note qualities: Tone, pitch, volume and duration. The music generator enables user manipulation of the Bezier paths, including touch input modification of the paths (e.g. dragging, forming etc.) that modify fundamental qualities of the corresponding note.

20 Claims, 16 Drawing Sheets

PRIOR ART.

PRIOR ART.

METHOD, SYSTEM, AND COMPUTER PROGRAM FOR ENABLING FLEXIBLE SOUND COMPOSITION UTILITIES

CROSS REFERENCE TO RELATED APPLICATIONS

This application claims all benefit, including priority, of U.S. Provisional Patent Application Ser. No. 61/648,856, filed May 18, 2012.

FIELD OF THE INVENTION

The present invention relates to computer systems for creating, modifying and generating sound. The present further relates to computer system implemented musical composition tools.

BACKGROUND OF THE INVENTION

Musical composition applications generally employ direct numeric value modifications (i.e. a MIDI "event list"), separate modifiable linear representations to define note characteristics, or simple rectangular bars to designate a pitch center over time against a pre-set grid, but with accompanying pitch modulation information displayed separately. Typically, a linear bar representation of a fixed note pitch and its duration, and another linear representation for pitch bend variables as related to the fixed pitch (FIG. 1) and still another to show relative volume levels (FIG. 2). While this method provides a degree of control over note characteristics it has a number of limitations.

Prior musical composition applications generally manipulate recorded, continuous sounds, whose basic pitch and volume properties are fixed. In prior art applications, pitch/volume can be roughly shifted overall as a whole, but the more complex a change, the greater the difficulty in enabling the manipulation of the sounds to reflect desired changes. Also, once a track is recorded (e.g. a violin track) prior art solutions enabling a change to the track for example from violin track to organ track would generally require re-recording of the whole track using an organ.

With some prior art musical composition applications, sounds are represented visually by a complex audio description of all the tones and overtones. The user can see that a sound sample is displayed, but may have no idea of its pitch and precise volume by simply looking at it. This creates restrictions in the ability of users to easily tune sound parameters. A musical composition includes numerous sounds, which compounds the problem.

Prior art musical composition utilities generally provide limited ability to manipulate musical content. There is a need for a system and method that provides musical composition functionality that is more flexible and responsive to users.

There is a further need for musical composition systems and methods that work well with touch interface computers.

Prior art linear visual presentations of a note's pitch variations and duration are not intuitive as they are managed by two different interfaces that function independently of each other (FIG. 1). Linear representations of pitch bend in prior art solutions are usually "stepped", moving abruptly from one value to the next. Or, should the extra care be taken, a line is typically drawn from one percentage point to percentage to the next, and any in-between values are inferred from these straight lines. This does smooth things out somewhat, but either case tends to produce abrupt pitch changes at those points, which do not accurately reflect the fluid pitch transitions of many instruments like the violin (as shown in FIG. 1).

Additionally, prior art linear representations of pitch typically display an arbitrary means of representation above or below the set pitch, typically a value in MIDI pitch bend (0→16383) or a percentage of maximum possible variation. This is counter-intuitive, as percentages displayed don't inform the user what the bent pitch is in relation to the musical scale, only the degree of deviation from the fixed pitch.

Even if extra care is taken to provide linear paths between key volume points, as shown in FIG. 2 this too can produce abrupt volume changes at the transition points, which do not accurately reflect the fluid volume transitions of many instruments like the violin.

Also, a number of prior art musical "drawing" computer programs are known. These generally enable a user to drag a finger/stylus across a touch screen to produce notes. On such program is SoundBrush™ (see FIG. 3 for an example of this method). In these prior art computer programs, note drawing happens by assigning a specific pitch to a specific pixel or group of pixels on the touch screen (the "View"). This provides limited entertaining functionality but does not constitute a real musical utility for a number of reasons.

First, pitch-to-pixel mapping technology typically results in pitch stepping as activation leaps abruptly from pixel to pixel (FIG. 3).

Second, pitch-to-pixel pitch mapping is generally crude when making later adjustments to a drawn note, as the user is limited to 'pixel on' and 'pixel off' options, and paths—once drawn typically lose their identity as a single, cohesive path. Even if these issues are addressed, prior art solutions are still limited in their ability to smoothly represent pitch or volume transitions, as any manipulated paths would still be subject to the stepping inherent in pitch-to-pixel relationships.

Also, most musical "drawing" programs only allow the user to input variations in pitch, as the volume is pre-set to a uniform level. This ignores a key component of music; the variations of volume within a note or group of notes.

Therefore there is a need for an improved system for creating, modifying and generating musical notes that improves on at least one of these aspects. There is a further need for an improved musical composition application that improves on at least one of these aspects. This is especially true in recent years given the wide spread acceptance of touch interface computers.

SUMMARY OF THE INVENTION

In one aspect there is a system for generating, controlling or modifying sound elements, comprising:

(a) one or more computers; and a (b) sound generating/controlling/modification utility ("sound processing utility") linked to the one or more computers, or accessible by the one or more computers, the sound processing utility presenting, or initiating the presentation, on a display connected to the one or more computers, of one or more music composition/modification graphical user interfaces ("interface") that enable one or more users of the system to graphically map on the interface one or more musical elements as parametric representations thereof, wherein the parametric representations are encoded with information elements corresponding to the musical elements, wherein the parametric representations, and the encoded information elements, can both be defined or modified by the user in the interface in a flexible manner so as to enable the user(s) to generate, control, or modify sound entities that achieve a broad range of musical possibilities, in an easy to use and responsive manner.

In another aspect, there is provided a system, wherein the parametric representations consists of parametric curves that define a path of curves.

In another aspect, there is provided a system, wherein the musical elements consist of pitch, volume, and duration of notes.

In another aspect, there is provided a system further comprising one or more audio processing components operable to play the sound entities.

In another aspect, there is provided a system, wherein the parametric representations encapsulate information for displaying a path on the interface, and also encapsulate the information for playing the sound entities, and wherein the parametric representations are modifiable based on user input to the interface such that modifications to the parametric representations make corresponding changes to the information for playing the sound entities.

In another aspect, there is provided a system, wherein the parametric representations are generated using one or more processes that create scalable parametric paths, such that the encoding of the parametric representations with the information elements is scalable, thereby providing flexible and responsive system characteristics.

In another aspect, there is provided a system, wherein the parametric representations are generated using Bezier paths.

In another aspect, there is provided a system, wherein the sound processing utility creates calculation points for a parametric representation corresponding to the musical elements into a Bezier path, stores the path, and if input is received from the interface to modify the parametric representation, more calculation points are added to the Bezier path corresponding to such input, thereby enabling the modification of the sound entities such that smooth transitions are audible when the sound entities are played using an audio processing component.

In another aspect, there is provided a music composition tool incorporating the sound processing utility is previously described.

In another aspect, there is provided a system wherein the interface includes one or more grids, each grid including a timeline, and permitting the user to create parametric representations and placing them in the timeline so as to construct a musical composition.

In another aspect, there is provided a system wherein the one or more grids include a pitch grid, wherein the pitch grid that is executable to allow one or more users to draw on the pitch grid one or more paths corresponding to a note and any pitch between any notes so as to create a spatial representation of pitch attributes of sound elements that correspond to an associated pitch frequency spectrum.

In another aspect, there is provided a system, wherein the one or more grids further include a volume manipulation grid that is synchronized with the pitch grid such that input to the pitch grid and the volume grid in aggregate enables modulation of the musical elements with a range of musical possibilities.

In another aspect, there is provided a computer implemented method for generating, controlling, or modifying sound elements comprising:

(a) displaying one or more music composition/modification graphical user interfaces ("interface") implemented to one or more computers including or being linked to a touch screen display;

(b) receiving one or more selections relevant to one or more musical elements using the interface;

(c) generating one or more parametric paths corresponding to the selections and encoding the musical elements; and (d) storing the parametric paths so as to define one or more executable sound entities, wherein the sound entities can be defined or modified using the interface in a flexible manner so as to enable the generation, control, or modification of the sound entities so as to achieve a broad range of musical possibilities.

In another aspect, there is provided a method, wherein the interface includes one or more grids, a first grid for selecting pitch attributes, and a second grid for selecting volume attributes; comprising:

(a) accessing, including iteratively, the first grid and the second grid, so as to define or modify pitch attributes and volume attributes for one or more sound entities;

(b) receiving input using the interface that the definition or modification of the pitch attributes and the volume attributes have been completed; and (c) storing or more sound entities defined by the selection of the pitch attributes and volume attributes to a data store, thereby providing one or more executable sound entities based on such pitch attributes and sound attributes.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The invention will be better understood and objects of the invention will become apparent when consideration is given to the following detailed description thereof. Such description makes reference to the annexed drawings wherein.

Figure 1:
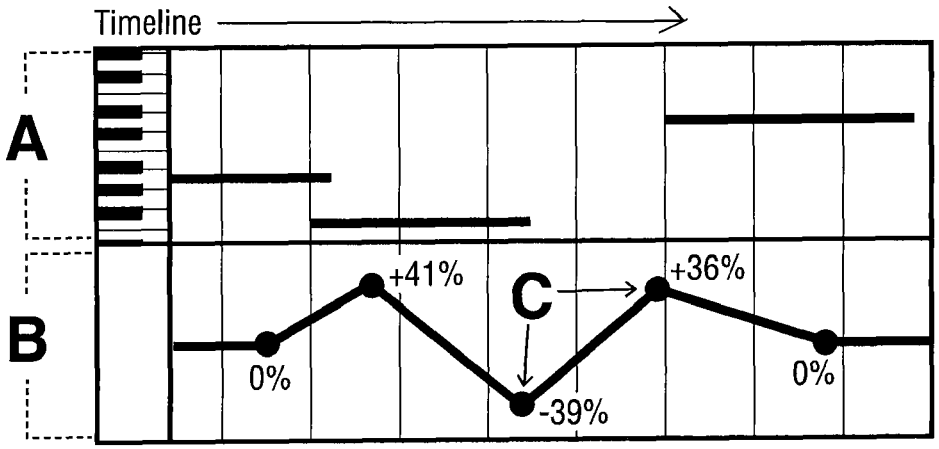
FIGS. 1 and 2 show linear representations of pitch, pitch bend, note duration and volume used in pre-existing musical creation computer programs.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION

In one aspect of the invention, a computer system, computer implemented method and computer program is provided that enables composition of musical content in a new and innovative way.

In one aspect of the invention, the computer system and computer implemented method of the present invention provides a novel and innovative mechanism for: (A) generating notes, (B) controlling notes, and (C) modifying notes, as described below.

In one aspect of the invention, the computer system includes at least one computer, the computer linked to a touch input device, the computer including or being linked to an application or an application repository that provides a sound engine; the sound engine when executed (A) presents one or more musical composition interfaces or screens including or being linked to one or more musical composition interfaces, that enable one or more users to access (B) a music generator/controller/modifier utility ("music generator"), so as to graphically map one or more musical notes by tracing one or more paths defined by Bezier paths and then processable by the music generator so as to define generally pitch, volume and duration of notes.

The system and method is designed to be very easy for learners use. The system and method of the present invention provides for the first time a new and more intuitive form of music notation where "the eye meets the ear".

In one aspect of the invention, a new system and method if provided for storing and playing musical notes. In one aspect, a musical note is defined by three properties or musical information elements: (A) pitch, (B) volume (or loudness), and (CD) duration.

In one aspect of the present invention, these properties are captured using a touch based graphical user interface ("GUI") presented touch screen interface. The GUI is linked to a computer program component that allows one or more users, based on touch input, to make one or more selections associated with such musical information elements, and these selections are displayed on the GUI, and these representations include, are based on or are linked to a plurality of parametric curves defining a "path" that encodes information corresponding to the musical information elements.

In another aspect of the invention, a suitable process or algorithm is used for defining these curves and paths so that the encoding of the curves/paths is scalable. In one contribution of the present invention, Bezier paths have been selected so that the paths are readily modifiable because Bezier paths are scalable indefinitely. The musical information elements, in one aspect, in effect are stored as algorithms of Bezier paths, which provides the remarkable and surprising flexibility and responsiveness of the system and method of the present invention.

One aspect of the invention is a new computer implemented method for encapsulating data that relates to a note.

In one aspect, the present invention combines the best of the previously separate pitch center "bars" and pitch modulation point and line technology, into a single mathematically calculated Bezier path object, which encapsulates or stores all necessary data to both display the path to a control user interface, and plays as the audio that it represents using a suitable music player.

Figure 4:
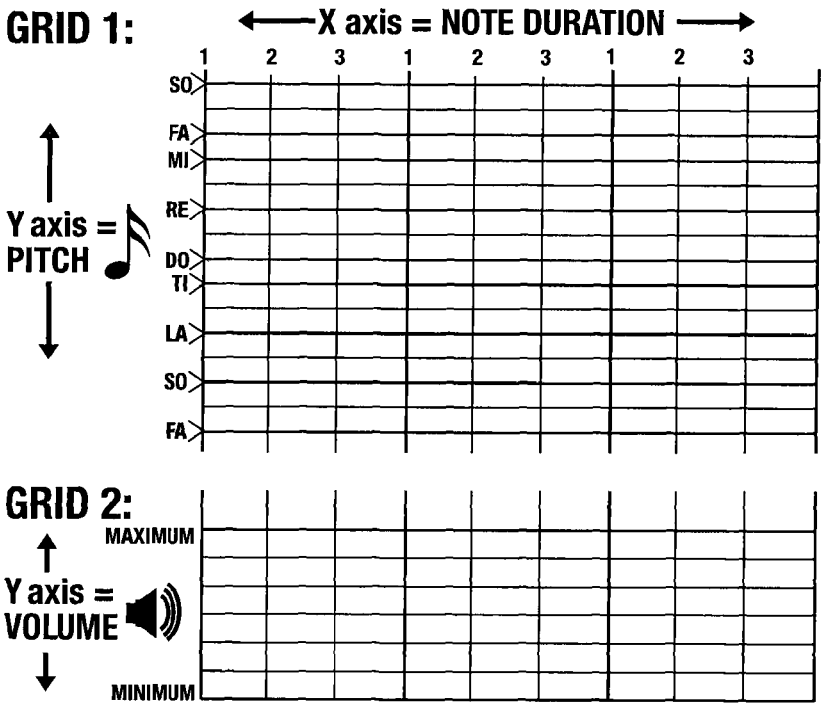
FIGS. 4 and 5 are examples of the new music notation system of the present invention that uses Bezier paths to denote beat, pitch and volume.
Figure 5:
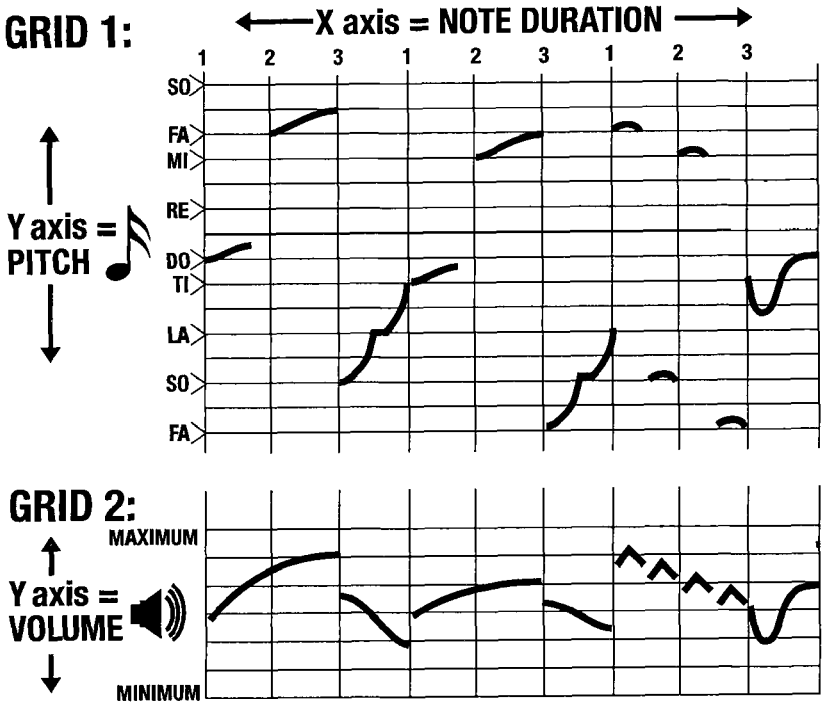

In one aspect, the present invention presents two easy-to-understand synced grids that accurately display volume and pitch as shown in FIGS. 4 and 5. Unlike that of most musical composition programs, the learning curve of the present invention is minimal.

This invention combines the best of the previously separate pitch center "bars" and pitch modulation point and line technology into a single mathematically calculated Bezier path object, which encapsulates or stores all necessary data to both display the path to control surface, and play to the audio it represents in the sound engine.

This invention allows the creation of music generation/control/modification applications that follow best practices in software design, by significantly improving the encapsulation of musical information into a representation of an associated musical note.

In another aspect, the system and method of the present invention takes the note pitch, pitch bend and note duration information that is represented in most musical composition programs as loosely related data (i.e. MIDI event list), or as two separate linear or pixel based representations, and combines this information into a single, accurate and more intuitive Bezier path object (FIG. 5). The Bezier path can be a curve having an arbitrary node count and a node type. This greatly simplifies note modification because user only needs to modify one path to modify the key note properties of note on, note off and pitch/pitch bend.

Figure 6:
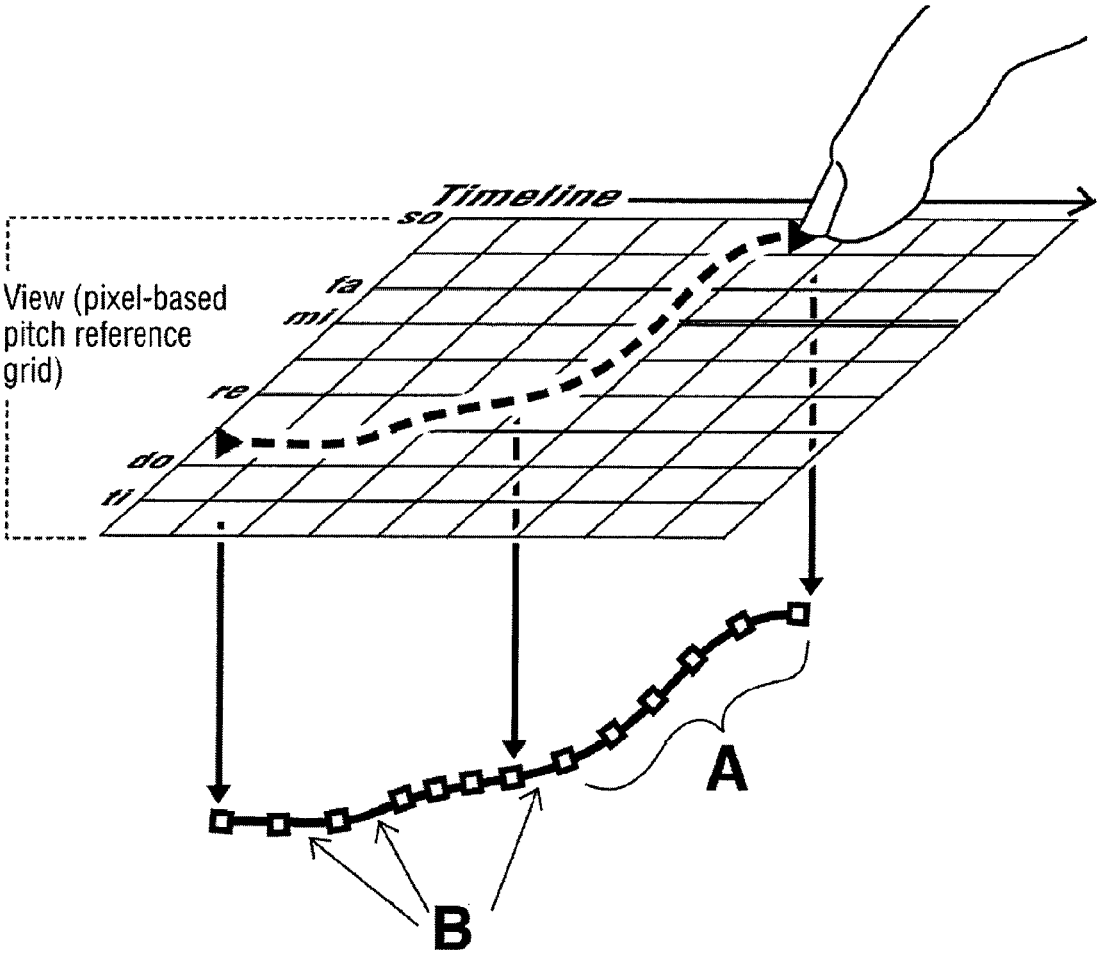
FIG. 6 shows pitch-to-Bezier-path relationship that the present invention uses that is a form of Model View Controller.

In another aspect, the system and method of the present invention adapts "Model-View-Controller" or "MVC" techniques, as shown in FIG. 6. In the present invention, this "MVC" pattern is used to calculate from that which is drawn on suitable graphical user interface ("GUI") displayed on a touch screen (such as the screen of a mobile device, tablet computer, or touch screen of a laptop computer or desktop computer) to create an underlying Bezier path or model object or Bezier model object (A). The GUI provides a control surface or "view" that is used by users to generate/control/modify notes.

When the Bezier model object is then displayed on the control surface, what is displayed may appear to be merely the pixels that the user has drawn using their finger or a stylus. But the underlying model object encapsulates or holds all data required to accurately display the path on the control surface and generate any data necessary to play the path accurately with an audio engine. The user may endlessly manipulate what is displayed in the view or control surface, but these manipulations are interpreted as actions on the underlying mathematical Bezier Model object. Therefore the system and method of the present invention is implemented such that the underlying Bezier model objects have an arbitrary degree of resolution, therefore it does not "step" as the representations in prior art solutions do, and the underlying Bezier model object also never loses its identity unless erased The mathematical descriptions of the underlying curved Bezier paths are used to calculate the pitch (or volume) as required anywhere along the curves of the Bezier path, to an arbitrary degree of resolution (B).

The system and method of the present invention generates musical notes by placing sufficient calculation points along its Bezier paths to create a smooth and pleasing sound. When its paths are stretched as in FIG. 7, the present invention simply adds more calculation points along the path (C), keeping the sound smooth and pleasing. This is possible because a Bezier path's algorithms allow it to be infinitely enlarged. The Bezier paths and therefore the musical notes of the present invention can be endlessly elongated and yet have the surprising result of maintaining not only accurate pitch, but maintaining audio fidelity. The present invention's musical notes are therefore resolution independent.

The present invention is therefore not dependent on direct pitch-to-pixel relationships, as represented in the view, to generate notes. This results in smooth and pleasing notes that imitate the fluid pitch and volume transitions of musical instruments such as the trombone. The sophisticated use of the Model View Controller patterns to generate mathematical Bezier "model" objects overcomes the 'stepped' pitch effect created by direct pitch-to-pixel dependency in prior art musical "drawing" programs.

The system and method of the present invention displays the underlying Bezier paths as accurate views of pitch and volume on their synced grids, as shown in FIG. 4. In a pitch grid view, pitch accuracy is achieved by having the pitch grid view display every semitone of the 12-tone musical scale. Thus a user can draw on the pitch grid a path that describes any note and any pitch in between notes in an intuitive manner as the path grid is a spatially accurate representation of the pitch frequency spectrum. This overcomes the confusing display of pitch bend as an arbitrary numerical or percentage of deviation above/below a fixed pitch that's employed by most prior art musical composition programs including the representative program depicted in FIG. 1.

As shown in FIG. 4, in one aspect of the invention, may use two time-aligned grids. The first grid is a visually accurate representation of pitch frequency where a whole tone, semi tone or any pitch in between can be represented by a simple yet malleable path drawn along the shared timeline. The second grid is a visually accurate representation of note volume range, showing highest to low (no) volume. Volume can be represented by a simple yet malleable path drawn along the shared timeline. Note duration is simply the length of the paths along the timeline. Thus the present invention negates the need to learn conventional music notation.

Figure 2:
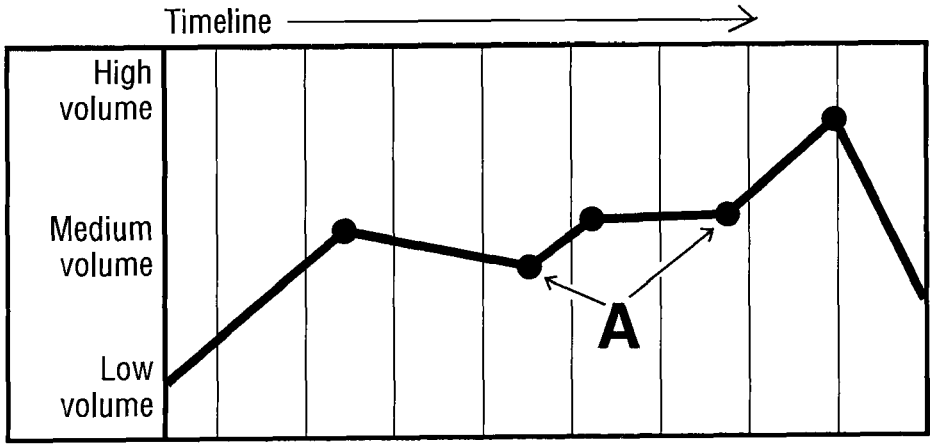
PRIOR ART. Fig. 2
Figure 3:
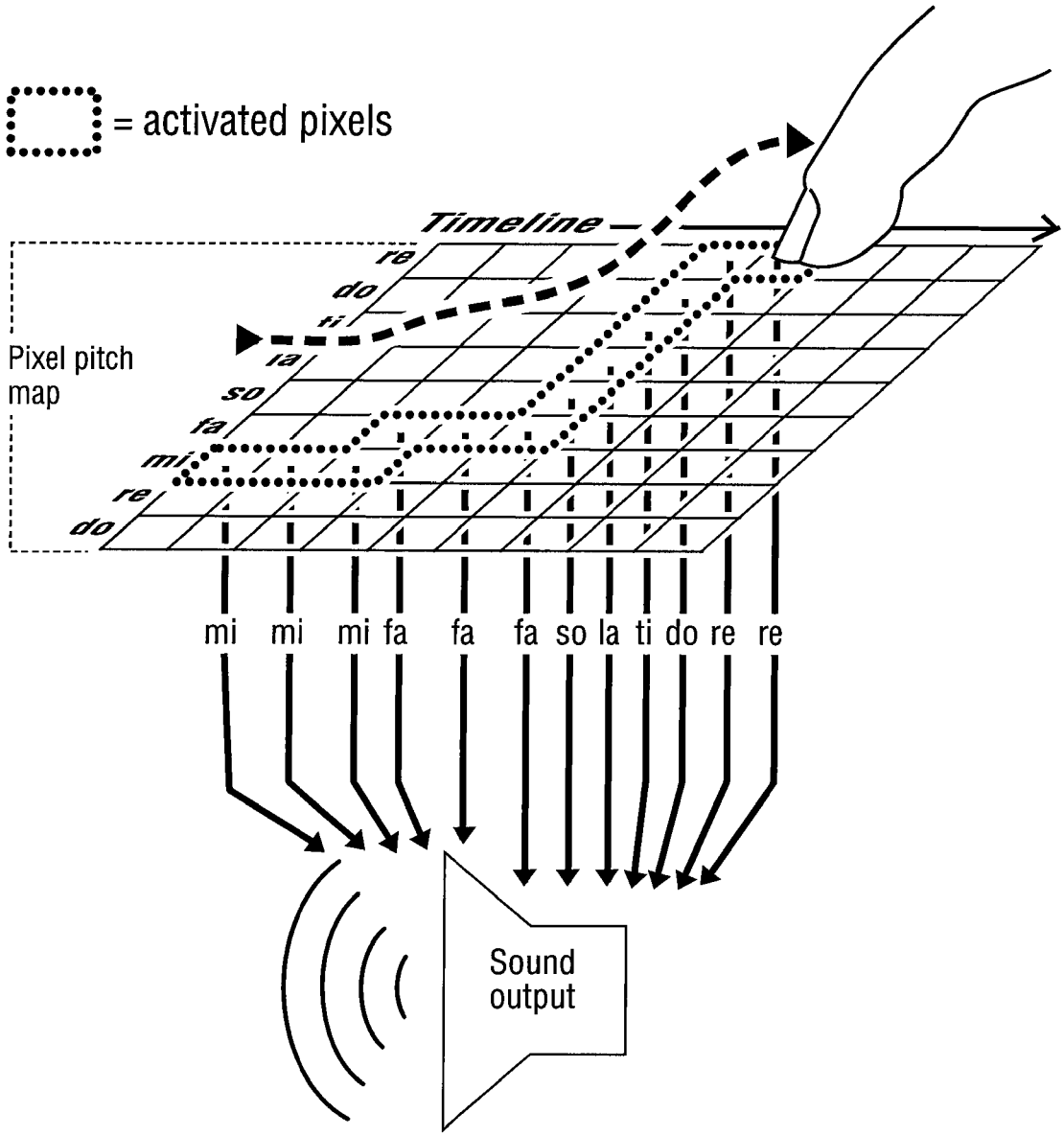
FIG. 3 shows example of pitch-to-pixel relationship used pre-existing music "drawing" computer programs.

As shown in FIG. 5, the system and method of the present invention uses underlying curved Bezier paths to accurately play any volume transitions and therefore is not limited by the flat point-to-point volume transitions used by most musical composition programs that produce abrupt changes in volume (for example as shown in FIG. 2). This allows the present invention to accurately imitate the fluid volume transitions of instruments such as the violin.

Figure 7:
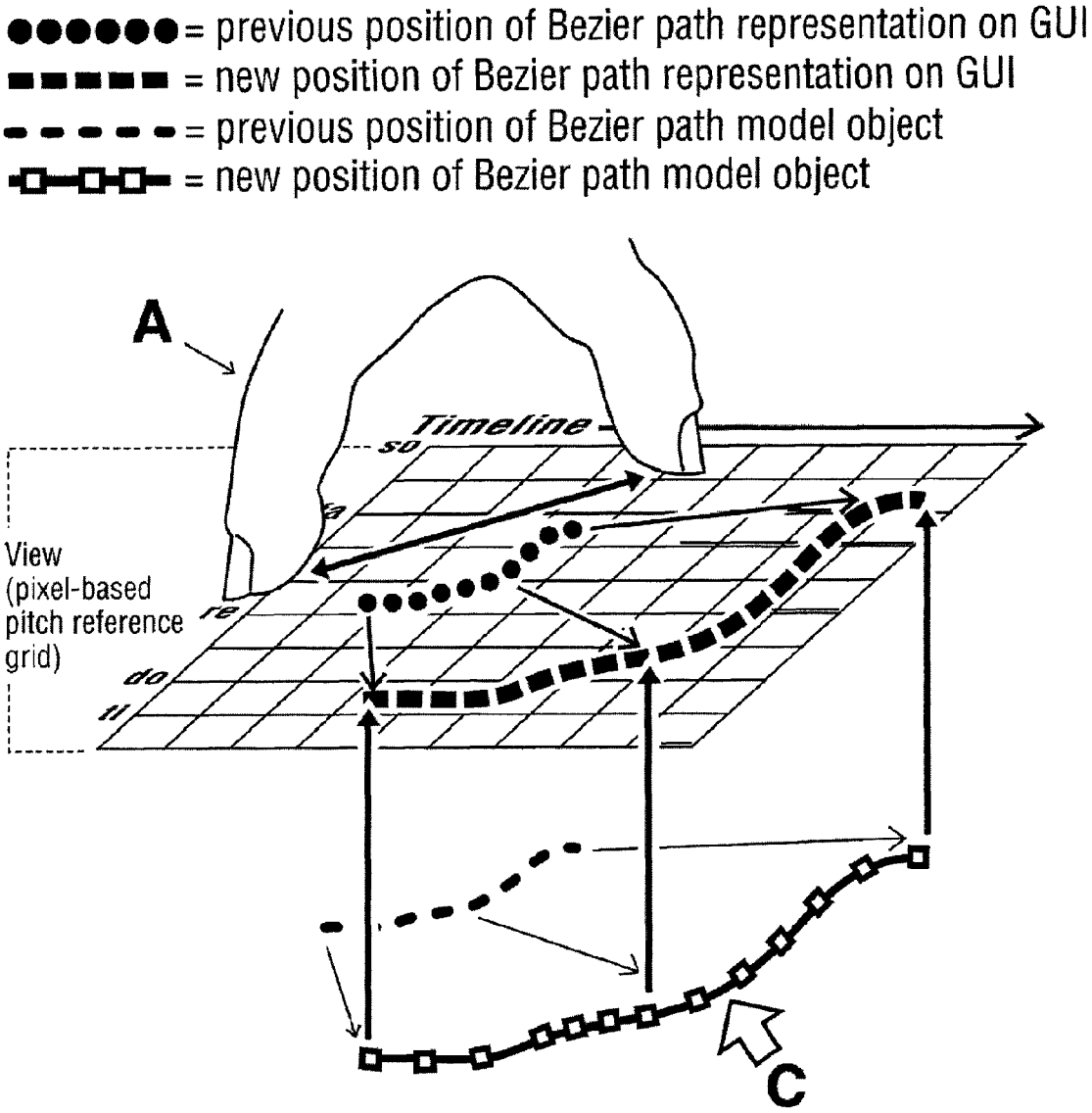
FIG. 7 shows method that the present invention uses to modify the Bezier paths.

Furthermore, as shown in FIG. 6, the system and method can include a GUI that is linked to a Model View Controller that allows a user to modify the underlying curved model Bezier paths into any description of a note's pitch and volume through the manipulation of their pixilated representations on the GUI. This allows for example for novel note modulations effected by the stretching, rotating, copying, twisting etc. of the note's Bezier path descriptions of pitch and volume, as shown in FIG. 7, thereby permitting highly flexible user interaction with musical content.

Implementation.

The functionality described may be implemented as a number of different computer systems and computer implemented methods. For example, the music generator of the present invention may be implemented as computer program implemented to a mobile device, a tablet computer, laptop computer or desktop computer. The music generator may also be implemented as an Internet service, for example a cloud networking implemented online service. Further details of possible example implementations of the present invention are provided below.

Figure 8:
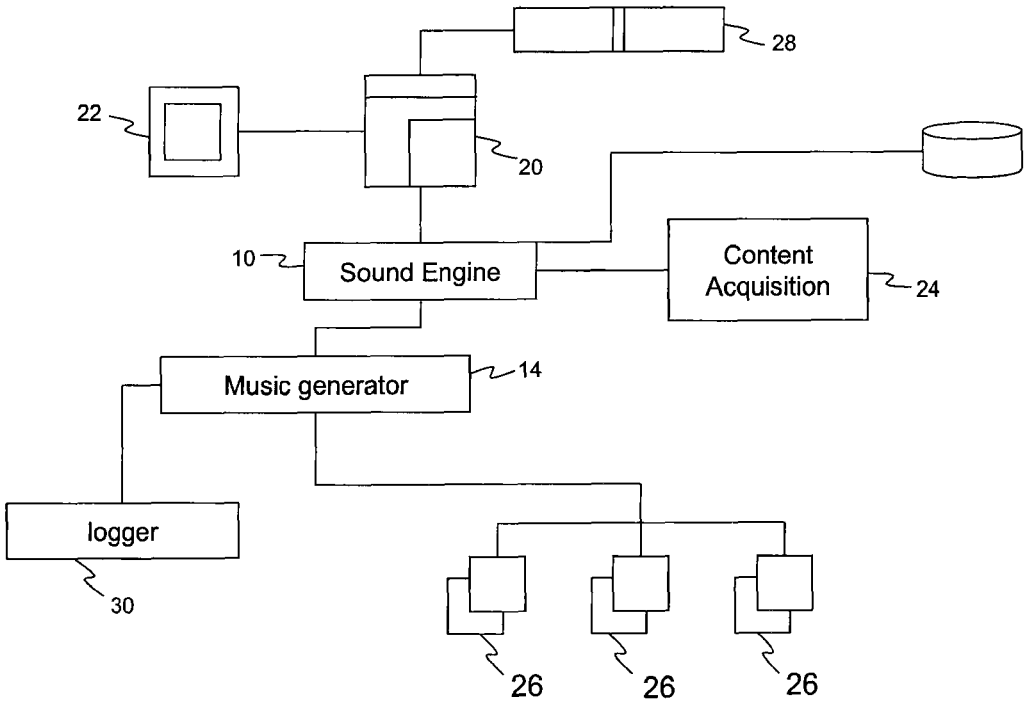
FIG. 8 is a system diagram illustrating one implementation of the computer system of the present invention, in a client computer implementation of the present invention.
Figure 9:
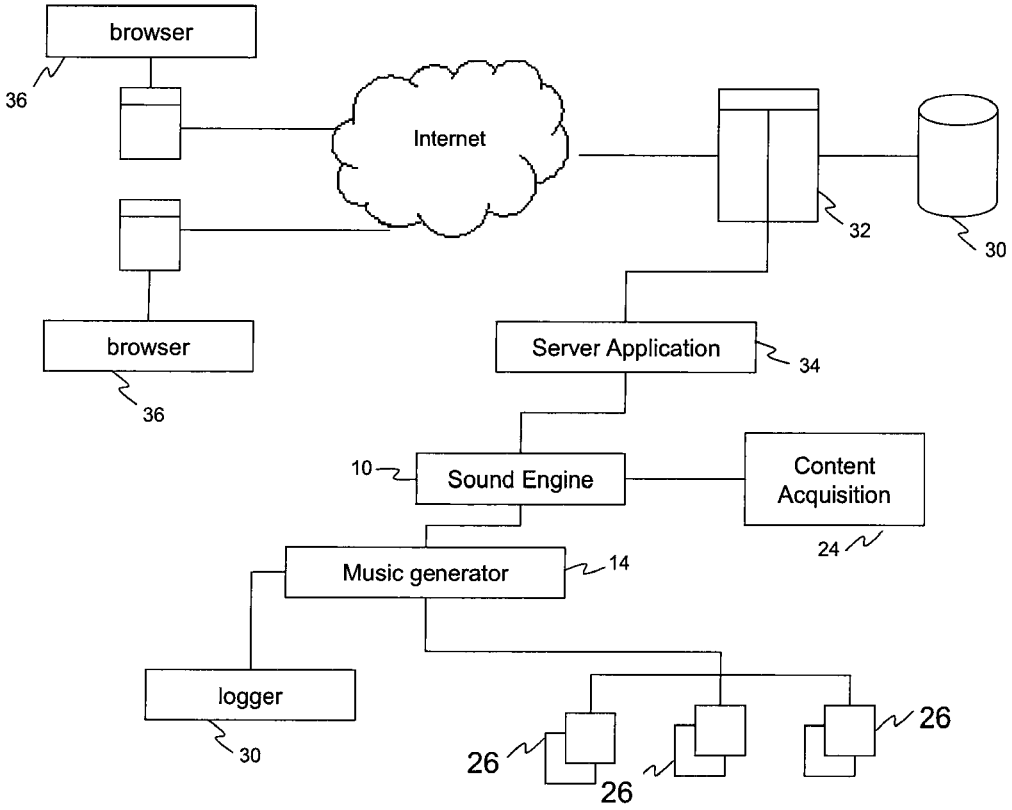
FIG. 9 is a system diagram illustrating another implementation of the computer system of the of the present invention, in a client/server computer implementation of the present invention.

In one aspect, the present invention may be implemented by configuring a computer program that when executed by one or more computer processors provides a novel and innovative sound engine (10), (FIGS. 8 and 9). FIG. 8 shows a possible client implementation of the present invention, and FIG. 9 shows a possible client/server or computer network based implementation of the present invention.

The sound engine (10) includes one or more musical composition interfaces that enable unprecedented flexibility in defining musical parameters for example for composing a song. The sound engine (10) may be implemented to or made available to any manner of computer device (20). The computer device is linked to a touch display (22).

More particularly, the sound engine (10) relies on and incorporates a novel and innovative music generator/controller/modifier (14) or "music generator". The music generator/controller/modifier (14), which may be implemented as a musical note builder component. The music generator/controller/modifier component (14) embodies a new method of the invention for generating a musical note, as described in this disclosure. Significantly, the musical note generator/controller/modifier component (14) embodies a method for controlling a note, for example using the musical composition interfaces (12) described below. The musical composition interfaces (12) in one aspect of the invention include the music notation graphical user interfaces of the present invention, also referred to as a "music mapping GUI" of the present invention.

The music generator (14) may also be used to modify existing musical content, for example as provided by the content acquisition component (24).

A logger (30) may be linked to the music generator (14) to track user interactions with the sound engine (10) based on the method described.

More particularly, the music generator/controller/modifier component (14) incorporates one or more computer implemented methods (implemented using suitable algorithms such as those described below) for graphically mapping one or more musical notes by using one or more music mapping GUIs (18) for (A) displaying the notes based on Bezier paths relating to pitch, volume and duration components thereof, the vectors defining a path that corresponds to these note components (pitch, volume, duration), and (B) enabling the user manipulation of the paths, for example using touch input modification of the path (e.g. dragging, forming etc.) and thereby modify pitch/volume/duration components thereof.

The music generator/controller/modifier (14) enables user modulation in a transparent way. The use of the music generator/controller/modifier is intuitive, and enables the creation and modification of notes, and any grouping of notes without the need for knowledge of musical notation or of the complicated workings of most musical creation programs. Furthermore, the Bezier path-based definition of notes enables the shifting of note attributes in a highly flexible way, thereby enabling unprecedented experimentation with musical elements. This allows the user to create a series of musical content components (26) or "sound entity", which are easy to create and modify.

In one particular implementation of the invention, the music generator/controller/modifier (14) defines an area in a GUI presented on a touch screen (22) that allows a user to define, using their finger or a stylus, a range of pitch, volume, and duration possibilities.

It should be understood that the paths referred to herein are Bezier paths that are defined by mathematical algorithms, and the sound engine (10) is operable to create musical notes using these paths.

Referring to FIGS. 4 and 5, two possible music mapping GUIs are illustrated, in this case the music mapping GUIs enabling the definition of paths that define pitch, volume and duration attributes. A vertical axis defines a visually accurate scale of pitch and volume parameters. A horizontal axis defines note duration on a timeline. One or more suitable Bezier path-based drawing methods or technologies are used to trace the paths described. In the case of FIGS. 4 and 5 the paths indicates variation of pitch and volume over time.

FIG. 9 illustrates a client/server computer implementation of the present invention. The sound engine (10) may be implemented to a server application (34) which may be loaded on a server computer (32). A database (30) may be connected to the server computer (32). Multiple network-connected devices, each having a touch screen, connect to the resources of the server application (34) via the Internet using a browser (36). The server application (34) may also be implemented as an application repository.

A skilled reader understands that various other computer system architectures are possible for implementing the functionality described herein.

The sound engine (10) may include the functions and features as previously described.

In one aspect of the invention, an easy to use and flexible musical composition interface is provided. Possible embodiments are illustrated in FIGS. 4, 5 and 15-31, and show how a user can generate/modify musical content by modulating Bezier paths, as well as how these Bezier paths are translated by system and method of the present invention.

A possible program screen or web screen may present one or more menus that enable a user to select from different music mapping GUIs that define attributes that collectively define how a path(s) are played. In one implementation, the system can include a one or more tools that enable the navigation between a plurality of Bezier paths that may define for example a song or song segment. The paths may, in one implementation, be represented as a series of sounds that are arranged in a sequence (indicating that sounds are intended to be played after one another as a single-note melody) or in parallel (indicating that sounds are intended to play at the same time or partially at the same time as a multi-note harmonies). Various other arrangements are possible.

The system and computer program of the present invention may incorporate functions and features similar to various prior art musical composition utilities, except that notes are defined, played by, and may be modified by, the Bezier path based technology of the present invention.

A skilled reader will understand that the present invention contemplates various different types of musical composition interfaces and associated features and user workflows. One aspect of the invention is a musical composition interface of various types that can be based on or incorporate the computer implemented methods of the present invention.

In addition to volume and pitch, the sound engine (10) can enable the definition of beat/duration parameters, and by enabling user configurability of pitch, volume, and duration, as described, the computer system of the present invention provides a highly flexible, highly tunable system for composing and playing music, in one implementation.

A skilled reader will understand that the present invention permits complete and fluid sound tenability, for example complete and fluid note control. It follows from this tunability and control that users can also modify existing musical content with the same complete and fluid note control, thereby enabling users to import source files and modify these based on user's intent, without the limitations that that prior art solutions set to composition and exploration by users.

The computer system of the present invention may include a musical content acquisition component (24) that is operable, for example, to acquire musical content for modification using the musical note builder component (16). For examples the musical content acquisition component (24) may be operable to acquire musical content such as a soundtrack. The musical content acquisition component (24) may be operable to pre-process the musical content (convert to Bezier path descriptions of its pitch/volume/duration), to enable processing by the system of the present invention. For example, the musical content acquisition component (24) can acquire one or more source tones from a library or other source, and the computer system of the present invention to modify the source tones, as described, and thereby create musical content from a collection of such tones.

Significantly, a Bezier path illustrated by operation of the GUIs shown in the Figures maps precisely to a musical note's pitch/volume/duration. The note's pitch/volume/duration may be changed by altering the path. A user may selectively modify musical notes and compositions by selectively altering the corresponding paths, as illustrated in the various Figs.

The computer system and computer implemented method of the invention provides significant malleability, thereby creating an unmatched, immersive, dynamic and exciting musical experience. Using the musical mapping GUIs of the present invention, users can for example (a) draw a note; (b) copy a note; (c) incrementally roughen, rotate, stretch notes, and so on. Each of these changes to the visual paths depicted by the present invention result in modification of the sound entity represented by the paths. In this way, the musical mapping GUIs constitute an graphical overlay, where each points maps to a musical parameter. The sound engine (10) includes a logger (30) that is operable to log the musical parameter selections represented by the paths so as to enable the sound engine (10), based on these selections to modulate sound output.

The present invention includes the conception of the idea that state of the art audio processing enables the creation of "live" musical tones, as opposed to modification of stored musical content. To this end, the sound engine of the present invention builds and rebuilds the musical note mapped to the note's current path positions, thereby creating a highly responsive and expressive musical environment.

Another important innovation of the present invention, is the realization that Bezier paths can be used as a user interface metaphor for control and shaping of musical tones, so as to enable user manipulation of musical tones within an extensive range so as to enable what a skilled reader will appreciate provides an extensive musical palette for creating music compositional elements.

The present invention has the innovative and surprising result of providing a computer system, and an easy to use GUI, that enables users to bypass the physical limitations of physical musical instruments and the musicians that play them, as well of the limited flexibility that is inherent to pre-existing art musical composition computer programs.

As shown in the Figs. Referenced herein, the computer program of the present invention utilizes Bezier path notation to instantly and precisely play any combination of the basic three note components—pitch, volume and duration—that a user can imagine. The computer program provides unprecedented levels of music creative control in the hands of users.

It will be readily apparent to a person skilled in the art that Bezier path-based notes of the present invention have unprecedented dexterity, in that they are can leap from any combination of pitch and volume to any other combination of pitch and volume, thereby permitting the user to create musical notes that would otherwise be impossible to express.

In one implementation of the present invention, the horizontal lines shown in the Figs. referenced below each represent a half tone, which is easy to understand as the musical scale is made up of half tones (e.g. TI to DO) and whole tones (two half tones e.g. DO to RE). A note's duration is defined by the length of its path. And the curvature of paths can precisely define the pitch and volume in an unprecedented exacting manner. In accordance with the present invention, there is no need for the complex and confusing use of sharps and flats used in pre-existing musical composition programs. The present invention is therefore intuitive and easy to learn.

It is important to understand that the present invention is operable to cover the complete range of frequencies audible to the human ear.

Also, the GUI provides a mechanism for various individuals to express themselves using music, who might not otherwise be able to do so because of the need to learn musical theory, and also the system and method of the present invention may be used by young and old, and individuals who have physical disabilities. The present invention enables users to compose and play the music that they imagine.

Music composed by the user may be stored on the database (34) shown in FIG. 9, and may be shared (by export as either a proprietary or as various common sound formats e.g. '.wav', '.mp3' or MIDI) or otherwise distributed in a number of ways, including for example a social networking environment linked to the server computer (32). The server application (34) can also enable collaboration between users of two or more computers, who may access one or more collaborative composition workflows enabled by the sound engine (10).

Perhaps more importantly, a skilled reader will appreciate that the musical notes created by operation of the present invention are highly responsive. The present invention allows the dynamic creation and playing of musical notes across a full range of pitches, volumes and durations, enabling musical virtuosity beyond what is ordinarily possible using musical instruments or prior art musical composition technologies. The present technology opens the door to radically new music composition methods.

The present invention enables, in one aspect, a new method of music notation that uses Bezier paths (defined using the GUI) to define musical content based on tone, pitch, volume, and duration. These paths enable precise definition of complex musical variations. These variations can be modulated instantly by operation of the computer system of the present invention.

One difference between computer system of the present invention and any prior art system is that the present invention uses the mathematical descriptions of Bezier paths to store and instantly play back any variation of a note's pitch, volume and duration. This allows the computer system of the present invention to be complete, instantaneous, precise and flexible. Manipulation of a note's paths by a user effects a corresponding and immediate modulation of its assigned note qualities. An important aspect of music is thematic variation and progressions. These aspects are highly tunable by modification and repetition of paths, in accordance with the present invention.

The computer system is adapted to enable a user to manipulate the pitch and/or the volume paths, as a group, as a single path, or a section of a path. The computer system supports one or more such manipulations by the user, for example a path or a section of a path or a group of paths or any combination of paths and sections of paths may be incrementally nudged, rotated, flipped, flopped, roughened, bloated, stretched, squeezed, twisted, zig-zagged, warped, and any combination of the foregoing. In addition, a skilled reader will appreciate any new tone can be applied to a path or a section of a path based on a user selection.

As mentioned, one contribution of the present invention is the reading of Bezier paths as musical notes. The present invention also provides a series of rules that can govern the reading (and therefore playing) of Bezier paths and variations of Bezier paths.

These rules cover two methods: 1) The selection of paths and/or sections of paths to play and 2) how to read paths that overlap.

Pitch Mapping

Figure 10:
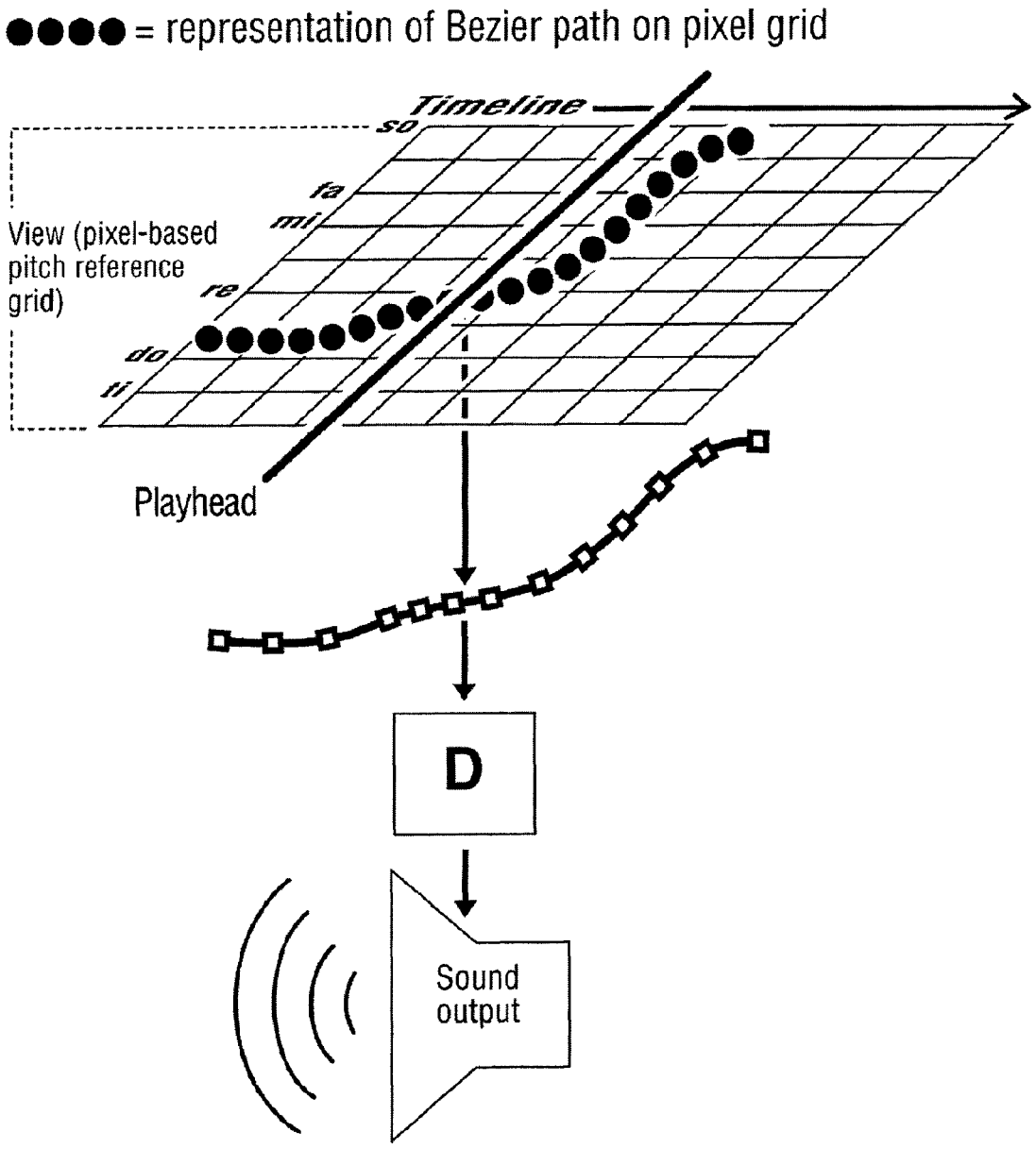
FIG. 10 shows a method that the present invention can use generate pitch from a model Bezier path.

One aspect of the present invention, as previously mentioned is the use of a Model View Controller system that generates notes based on the algorithms of underlying curved model Bezier paths that describe the note's pitch and duration (for example see FIGS. 6 and 10).

Following the capture of the original drawing points from the present invention's "View" components, all further displays of the data to the user through the software's "View" components, are in fact, actually representations of the underlying calculated Bezier model objects.

The present invention uses the pitch grid view only as a frame of reference to determine basic pitch parameters of a Bezier path that is generated to the user's finger/stylus drag across the GUI (FIG. 6). The Bezier path is a complex multi-node path of arbitrary node length and type, and is maintained in memory as such for future playback or modulation.

It is this Bezier path (A) that is interpreted and displayed on the GUI, not the original finger drag/stroke (though it may look exactly the same on the GUI). It is the use of this malleable underlying Bezier path that allows the displayed stroke to be modified into any pitch description.

Since the Bezier path maintains its coherent identity through a mathematical relationship to a set of nodes it is possible to manipulate the path shape while having it maintain its general shape. The path can be smoothly and infinitely stretched, shrunk, deformed, copied or moved etc., while still maintaining pitch description that is accurate to its current modification, allowing for accurate data from any point on the curve to continue to be gathered, maintaining the fidelity of note quality (FIG. 7).

The computer system may present a conventional playhead (or UI component that shows the current progression of play of a musical content) that is modified based on the present invention to move across the grid's timeline and encounter the start of a Bezier path, the pitch played is generated by means of mathematical calculation of points along the path (see calculation methods below). These calculations may be made on-the-fly, or may exist as a pre-calculated set of points to be referenced. The calculated pitches are then played by means of proprietary pitch commands to an oscillator or a sampler, or translated into a standards-compliant audio control language such as MIDI (FIG. 10, D).

This results in being able to have smooth transitions between pitches: calculation points are varied in their time intervals along the curved Bezier path to ensure a pleasing 'un-stepped' sound. This is especially important when emulating instruments such as the trombone or violin, in which pitches are often transitioned by means of smooth gradients or 'slides'. It is important to note that these calculation points have no relationship to the pixels on the view pitch grid.

The calculation methods used may include but are not limited to those detailed below.

Calculation Using Pitch Bend:

The present invention takes the path drawn onto the touch surface by the mouse, finger or stylus and converts it into a multi-node Bezier path, that incorporates:

a) Note start time b) Note length c) Note pitch modulations over time

The pitches along the Bezier path are calculated by discovery of a Y position on the path in relation to a given X value input—an example of the calculations in the case of a Cubic Bezier Node (the most common node type)—is given below:

Where t=an X position, given in percent, between the start and end node, of a cubic Bezier path segment.

$$t=(x-\text{StartPoint}.x)/(\text{EndPoint}.x-\text{StartPoint}.x);$$

$F_1(t)=t^3$ $F_2(t)=3t^2(1-t)$ $F_3(t)=3t(1-t)^2$ $F_4(t)=(1-t)^3$

These equations are then combined:

$$p\cdot X=\text{StartPoint}X*F_1(t)+\text{ControlPoint1}X*F_2(t)+\text{ControlPoint2}X*F_3(t)+\text{EndPoint}X*F_4(t)$$

$$p\cdot Y=\text{StartPoint}Y*F_1(t)+\text{ControlPoint1}Y*F_2(t)+\text{ControlPoint2}Y*F_3(t)+\text{EndPoint}Y*F_4(t)$$

Where:

$F_1$ are the Bezier functions, $F_1$, F2, F3, F4 above t is a percentage of the distance along the curve (between 0 and 1) which is sent to the Bezier functions $F_1$, F2, F3, F4 p is the point in 2D space, we calculate for X and Y, and then combine to make the point These calculations can take place on-the-fly, or can generate a pitch lookup table of arbitrary resolution.

Corresponding MIDI values (or those of another audio control language) are then generated, including:

a) Best choice of pitch center for degree of least modulation b) MIDI 'note on' message at the correct point in timeline of the start of the path c) MIDI 'note off' message at the correct point in timeline of the end of the path Live playback of the path is affected by generating MIDI pitch bend data at points along the path to bend the pitch of the note to represent that of the path. MIDI data is calculated to the degree required to create a smooth tone to the human ear. The path can be modified or stretch in any fashion, and the MIDI data simply recalculated as required using the following formula:

Where:

f1=choice of pitch center of Bezier Path f2=calculated pitch of specific point on path c=difference in cents from pitch center to pitch of path point $$c=1200\times\log_2(f_2/f_1)$$

This is then calculated against a neutral pitch bend value (the half way point in the total pitch range), in the case of MIDI, this neutral value is 8192:

cps=cents per pitch bend step npv=neutral pitch bend value pbv=final pitch bend value c=calculated difference in cents between root pitch and current value on path $$pbv=npv+(c\times cps)$$

This final pitch modulation value is then applied to the pitch center to output the correct pitch for the given position on the Bezier path.

Volume Mapping

The present invention uses a volume view grid that uses Bezier paths representing changes to volume along the timeline as part of the GUI. Users drag a finger, stylus or mouse across the grid to create the underlying curved model Bezier path that describes variation in note volume.

Bottom of the volume graph is zero volume, top of the graph is maximum and path Y position is simply a percentage of this. Path position on the Y axis for a given X position is calculated as above in the case of pitch, but instead of it being translated into pitch modulation information, this path Y position is translated into a percentage of overall volume. In the case of MIDI, a number is generated between a MIDI volume value of 0 and a maximum volume value of 127.

Such that:

$$\text{final volume}=\text{max volume}\times(\text{calculated } Y \text{ position}/\text{max } Y \text{ position})$$

These volumes can be calculated on-the-fly or pre-calculated to an arbitrary degree of precision for playback.

Notation Method

A skilled reader will appreciate that prior art music notation methods, including variations on classic notation, assume that the clef notes used are describing the pitch and duration of various musical instruments. Clef notes are rigid and one-dimensional and requires a complex array of notes to describe the many variations in pitch and duration (including the use or various rest notes).

One aspect of the invention is a new notation method, which differs in that it uses Bezier paths to describe pitch, allowing for the precise expression of any pitch and length, and does not assume to imitate a musical instrument's limitations in pitch expression or length of note (FIGS. 4 and 5).

Prior art musical staff notation methods use imprecise verbal descriptions to describe volume e.g. 'forte' (loud) and 'crescendo' (increasing in volume). The new notation method of the present invention uses Bezier paths to describe volume (FIG. 5), allowing for the precise expression of variations of volume and volume duration, and does not assume to imitate a musical instrument's volume limitations.

Prior art notation generally uses horizontal lines across the Y (vertical) axes to indicate pitch, but the horizontal lines are spatially inaccurate as they are equidistant whether there is a semitone or a whole tone between consecutive notes. Therefore prior art notation necessitates the use of complicated and confusing key signatures consisting of sharps and flats to denote whether the space between horizontal lines represents a whole or a half tone. In contrast based on the novel notation method of the present invention, the horizontal lines across the Y axis accurately represent the distance between each of the 12 half tones that make up the musical scale and therefore accurately displays note pitch frequency (FIGS. 4 and 5). This allows the user's drawn path to easily and precisely express changes in pitch frequency, whether it's a whole tone or a semitone or any fraction thereof.

FIG. 4 provides a representative illustration of a possible graphical user interface for operating the computer system of the present invention. Specifically, the depicted interface enables the manipulation of a note through a pitch manipulation timeline grid and a volume manipulation timeline grid. The timeline of the two grids are synced, so as to enable along their mutual timeline the manipulations required to accurately modulate the note within the range of musical possibilities.

More specifically, FIG. 4 shows a notation system using two XY grids. The first grid is for notation of a note's pitch in which X (vertical) represents note duration in which timeline moves left to right, and Y (horizontal) represents note's pitch. The second grid aligns to the first grid along X axes. In the second grid, X represents note's duration in which timeline moves left to right, and Y represents note's volume range from silence to maximum volume. Note duration, pitch and volume axes can be oriented in any direction.

A skilled reader will appreciate that numerous variations of the various interfaces shown are possible. For example, the timeline can move right-to-left or bottom-to-top or top-to-bottom or any variation thereof. X axes can be added to grids to accommodate any length of composition and can represent any beat configuration (3/4, 6/15 etc.) and beat length in time. Y axes can be added to pitch grid to accommodate any number of octaves. Also a plurality of pitch and volume grids assigned to multiple voices can by synced along their timelines to allow for the creation of complex orchestrations (for example).

A note's pitch and volume are defined on the two grids by drawing descriptive Bezier paths. These paths defining pitch and volume may be thin enough to be accurately placed on the grids, but can be any length or position on their respective grids, including but not restricted to: straight lines, curves or any variation thereof, and paths overlapping on the X axes. These linear descriptions are therefore capable of describing any imaginable configuration of a note's pitch, volume and duration.

Users may assign 'voices' (e.g. electric guitar, violin) to pitch paths or sections of pitch paths. Each 'voice' can be shown on the display by different coloured paths or by variations on the stroke of the paths (for example a dotted path). Different voices can be overlaid on the same grid, or layered on separate but XY-aligned grids that the user toggles between. Users can input paths by drawing freehand (rougher), or freehand with automatic smoothing, or by draw options in which a drawn path 'snaps' to beat or pitch, or by placing anchor points connected by straight lines or curves.

Path Modulation Methods

Music composition requires variations of a note or group of notes. The present invention enables variations of notes or group of notes by applying to their associated paths one or more of three methods: 1) Modification of a paths or group of paths, 2) Variations of the playing of paths or sections thereof by selecting specific grid areas, and 3) Variations of the rules governing the reading (playing) of paths.

1) Modification of a Paths or Group of Paths

All paths drawn (straight or curved) can be Bezier paths with anchor points. Anchor points, section(s) of path between anchor points and whole paths can be selected. Anchor points can be changed from a rounded to corner point, as shown in FIG. 4 in one embodiment. Anchor points can also be added anywhere along an existing path to enable further modulation.

Figure 11:
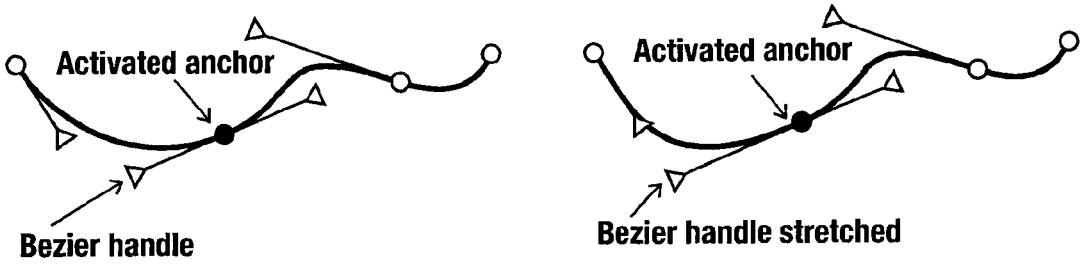
FIGS. 11-14 are examples of various pitch and volume path modulations possible within the new music notation system of the present invention.

An individual anchor point on a curved path or end of a curved path can be selected to show its Bezier handles. A section of a path between two anchor points can also be selected to show the Bezier handles related to that section of path. These handles can be moved to change the curve of an individual path, for example as shown in FIG. 11.

Whole paths and/or sections of paths can also be selected individually either sequentially or discontinuously, or by selecting a specific grid area(s), then modified by methods including but not restricted to:

Path Modification Sub-method 1: Paths and/or section(s) of paths can be deleted.

Path Modification Sub-method 2: Paths and/or section(s) of pitch paths can be copied and pasted within its pitch grid or into a new pitch grid. A user can paste selection as an addition on top of existing paths, or paste to an empty area of a pitch grid, or any fractional overlap thereof.

Path Modification Sub-method 3: Paths and/or section(s) of volume paths can be copied and pasted within its volume grid or into a new volume grid. A user can paste selection as an addition on top of existing paths, or paste to an empty area of a volume grid, or any fractional overlap thereof.

Path Modification Sub-method 4: Paths and/or section(s) of pitch paths can be copied and pasted into its related volume grid or into an unrelated volume grid. A user can paste selection as an addition on top of existing volume paths, or paste to an empty area of a volume grid, or any fractional overlap thereof.

Path Modification Sub-method 5: Paths and/or section(s) of volume paths can be copied and pasted into its related pitch grid or into an unrelated pitch grid. A user can paste selection as an addition on top of existing pitch paths, or paste to an empty area of a pitch grid, or any fractional overlap thereof.

Path Modification Sub-method 6: A whole path can be stretched and squeezed both horizontally or vertically.

Path Modification Sub-method 7: A whole path can be selected and moved intact and incrementally within its grid.

Path Modification Sub-method 8: Paths and/or section(s) paths can be incrementally rotated.

Path Modification Sub-method 9: Paths and/or section(s) of paths can be flipped both horizontally and vertically.

Path Modification Sub-method 10: Paths and/or section(s) paths can be incrementally scaled up and down in size.

Paths and/or section(s) of paths can also be modified by filters and/or their incremental applications. These filters include but are not restricted to: free distort, pucker & bloat, twist, zigzag, roughen, warp variations, duplication using offset variations, inclusion/exclusion of paths contained within paths, and variable-stepped blending between two selected paths.

2) Variations of the Playing of Paths or Sections Thereof by Selecting Specific Grid Areas.

Figure 12:
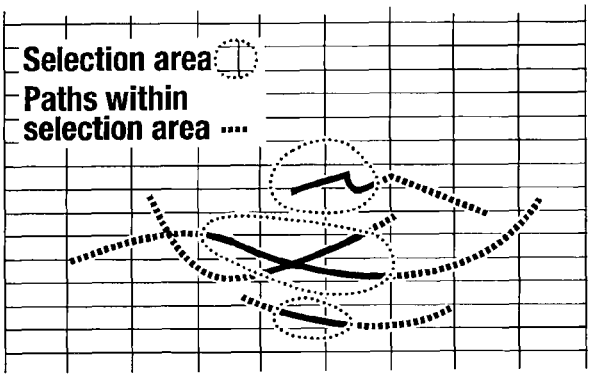
Figure 13:
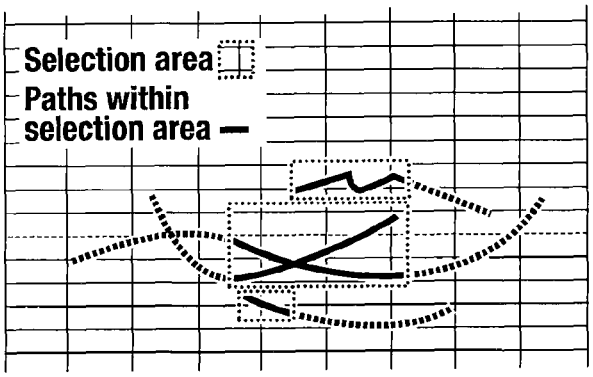
Figure 14:
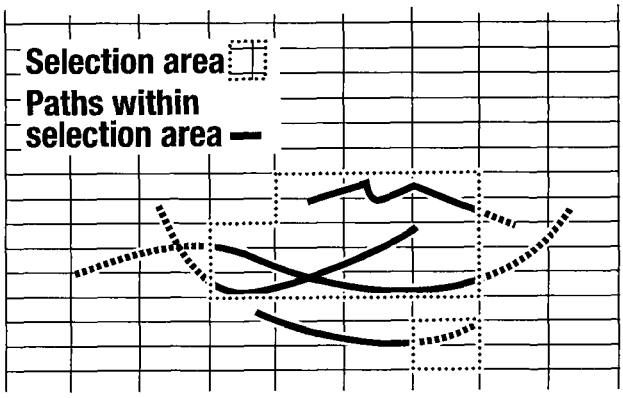

A user selects a specific area(s) of pitch and/or volume grids to be played. Selected area(s) can be any shape (FIG. 12). This area(s) may contain whole paths and/or sections of paths. The user can be presented with the option of making selections constrained for example to a rectangular area(s) (FIG. 13) or to rectangular area(s) that snaps to beat and/or pitch axes in the pitch grid, or to beat and/or volume axes in the volume grid (FIG. 14).

Selected area(s) in pitch and/or volume grids, including all paths and sections of paths contained therein, can be played applying any of the read rules that follow.

3) Variations of the Rules Governing the Reading (Playing) of Paths

Reading of notation may move left to right. When just one path is encountered on the X axis of pitch or volume grid, the one path is read. When additional paths are encountered i.e. when pitch paths or volume paths overlap X axes, they trigger the application of read rules that include but are not restricted to the implementations described after this.

FIGS. 15-31 help understand possible implementations of the music generator/controller/modifier of the present invention, and the different system-user workflows that are associated with operation of the computer system of the present invention. More specifically FIGS. 15-31 illustrate particular rules for operating the computer system of the present invention.

Figure 15:
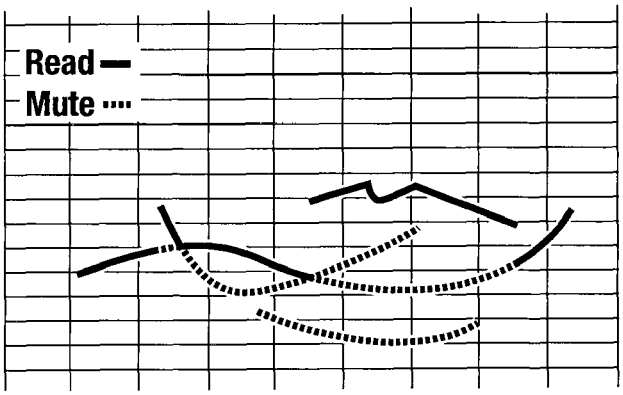
FIGS. 15-31 are examples of various rules that can govern the reading of pitch and volume paths within the new music notation system of the present invention.

Rule 1) Read Highest Path. As a timeline moves left to right and encounters an overlap, the path describing the higher pitch/volume takes precedence and is read. Lower pitch/volume described by path(s) are muted (FIG. 15). If different voices (e.g. electric guitar, violin) have been assigned to different pitch paths within a grid, the voice assigned to the highest pitch path is read.

Figure 16:
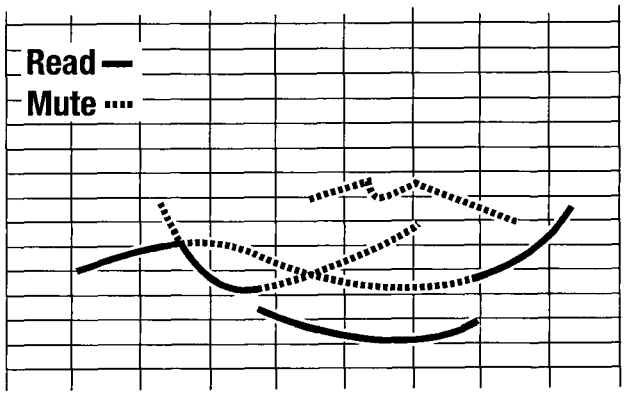

Rule 2) Read Lowest Path. As a timeline moves left to right and encounters an overlap, the path describing the lowest pitch/volume takes precedence and is read. Higher pitch/volume described by path(s) are muted (FIG. 16). If different voices (e.g. electric guitar, violin) have been assigned to different pitch paths within a grid, the voice assigned to the lowest pitch path is read.

Figure 17:
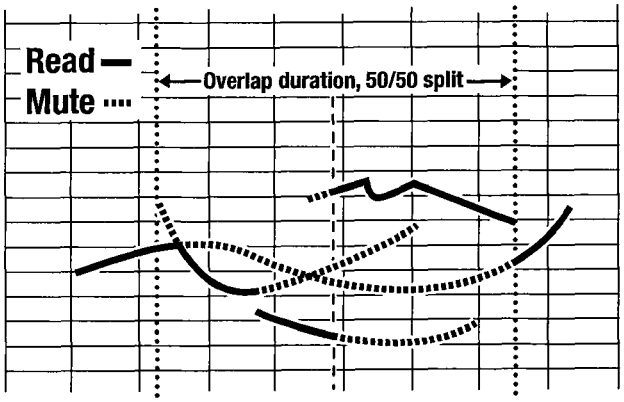

Rule 3) Shared Read Of Highest And Lowest Paths. Length of overlap of two paths can be calculated and read time can be shared between two paths for duration of their overlap (FIG. 17). Split can be 50/50, 73/27 or any fraction of overlap duration.

Figure 18:
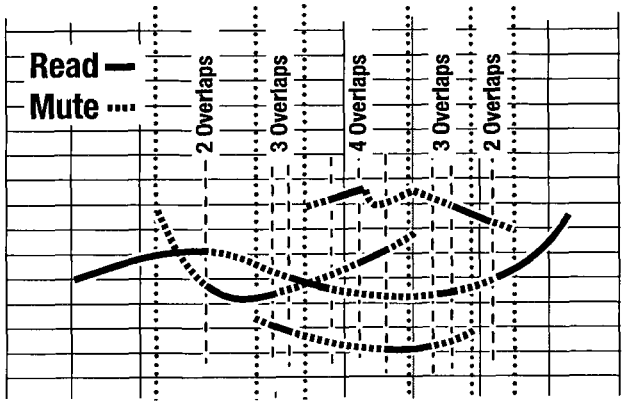

Rule 4) Shared Read Of All Overlapping Paths. Length of overlap of paths can be calculated and read time can be divided between the paths for the duration of their overlap. For two paths overlapping, the read duration of the overlap can be split in two lengths distributed between the two paths. For three paths overlapping, the read duration can be split into three lengths distributed between the three paths, and so on (FIG. 18).

Figure 19:
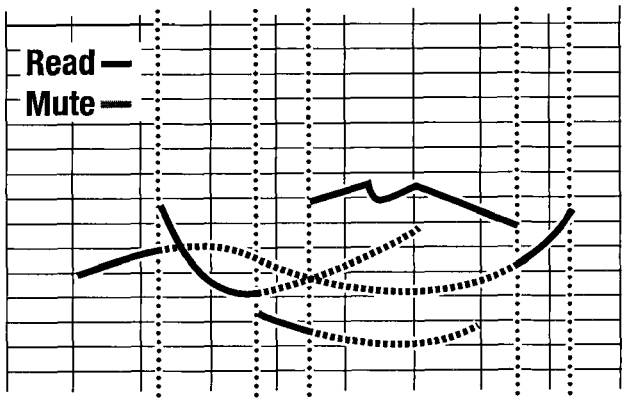

Rule 5) Read Newest Path. As timeline moves left to right and encounters a new path, the new path can be read and all other paths are muted. New path can be read regardless of whether it represents the highest or lowest pitch. Once a new path starts to be read all other paths are muted (FIG. 19).

Figure 20:
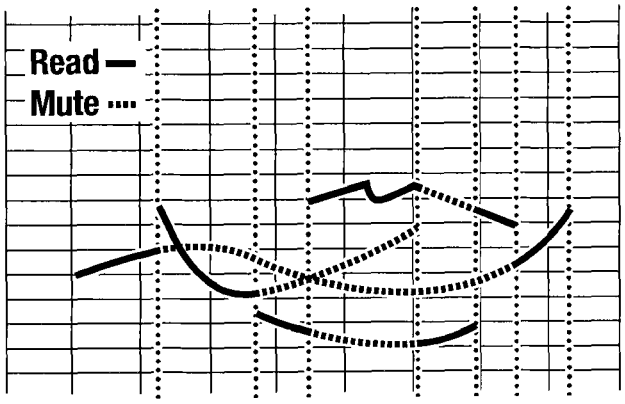

Rule 6) Read Alternating Paths As Defined By End/Beginning Of Any Overlapping Path Met In Timeline. As a timeline moves left to right, the beginning or end of overlap paths are used as markers to divide X axes into discrete sections. These discrete sections are read in an alternating order (FIG. 20).

Figure 21:
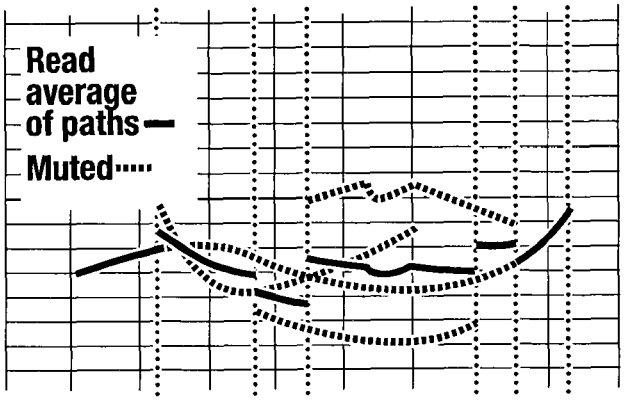

Rule 7) Read Average Of Highest And Lowest Paths. Average of all overlap paths can be read (FIG. 21).

Figure 22:
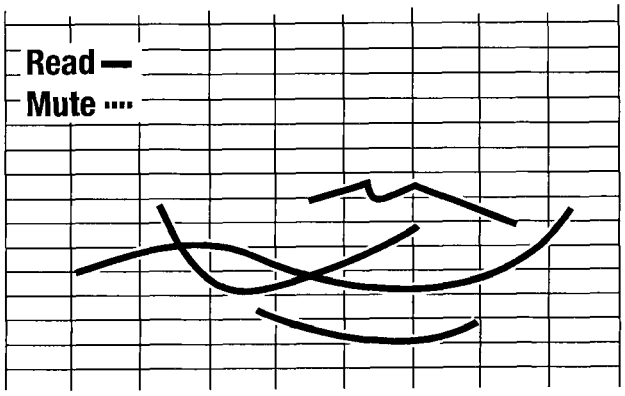

Rule 8) Read All Paths. As timeline moves left to right, all paths encountered are read (FIG. 22).

Figure 23:
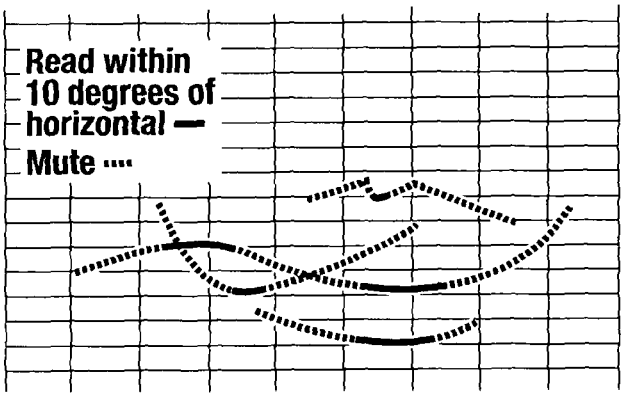

Rule 9) Only Read Paths That Fall Within A Specified Angle. As timeline moves left to right, in one aspect only paths are read that fall within a defined angle (FIG. 23). For example this read rule could be set to ignore curves that get too vertical.

Figure 24:
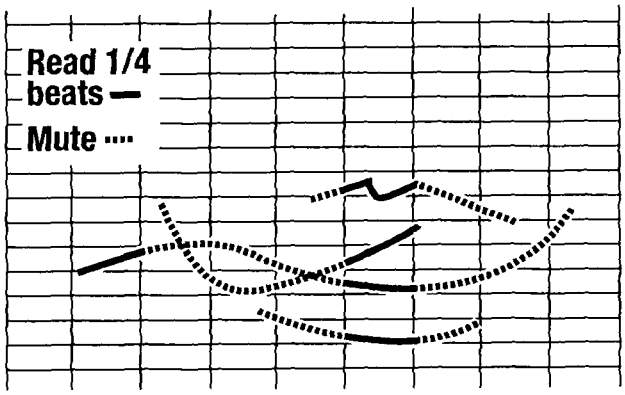

Rule 10) Only Read Paths That Fall Within A Specified Beat/Time Period. As timeline moves left to right, in one aspect only paths are read that fall within a specified beat (FIG. 24). For example this read rule could be set to play only paths that fall within every first 1/4 note of 4/4 time, or any time/beat variation or combinations thereof.

Figure 25:
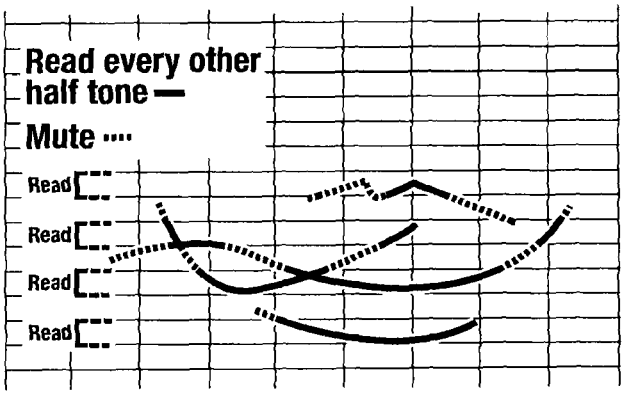

Rule 11) Only Read Paths That Fall Within A Specified Pitch Frequency. As timeline moves left to right, in one aspect only paths within a specified pitch range are read (FIG. 25). For example this read rule could be set to only play paths that fall within 1/8 tone above or below standard scale frequency, or to play only paths that fall within any specified pitch range or combinations thereof.

Figure 26:
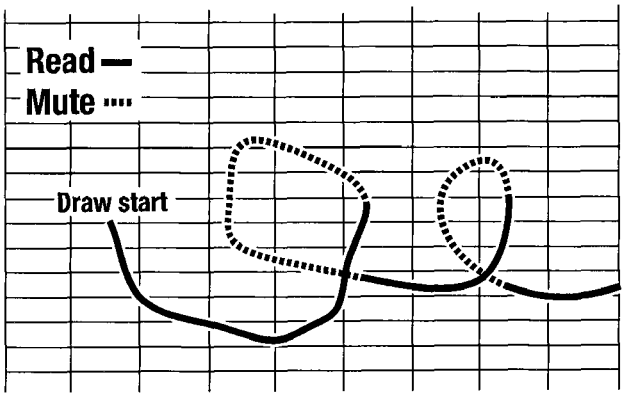

Rule 12) Only Read Paths Or Section Of Paths That Are Furthest As Drawn On the Timeline. As user draws paths back-and-forth on timeline, in one aspect only paths or sections of paths that are furthest on the timeline are played (FIG. 26). Any paths drawn on grid timeline before the furthest paths or sections of paths are muted.

Figure 27:
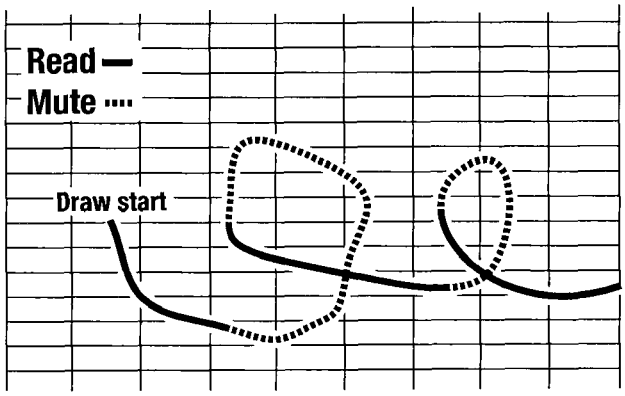

Rule 13) Only Read Paths or Section of Paths That Are Most Recent As Drawn On the Timeline. As user draws paths back-and-forth on the timeline only the most recently drawn path will be played if new path or sections thereof overlap a pre-existing path (FIG. 27).

Figure 28:
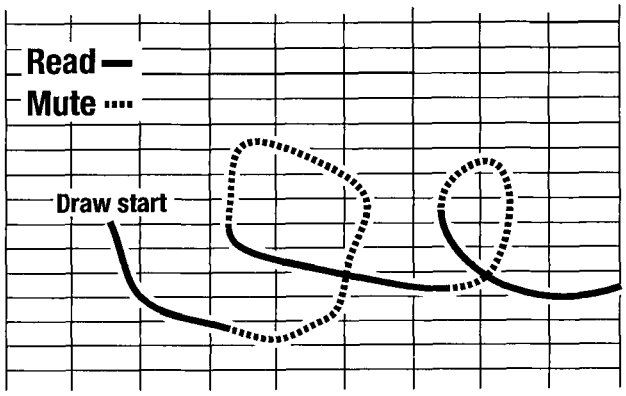

Rule 14) Read Nearest Whole Or Halftone. As user draws path on pitch grid the nearest whole or halftone can be played (FIG. 28).

Figure 29:
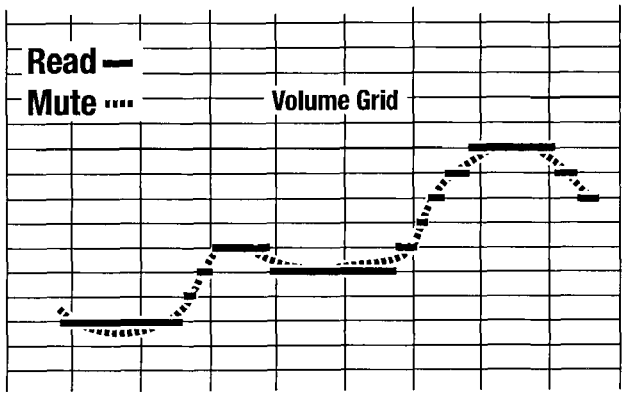

Rule 15) Read Nearest Volume Increment. As user draws path on volume grid, volume level nearest to path (as indicated by discrete volume increments on interface) can be played (FIG. 29).

Figure 30:
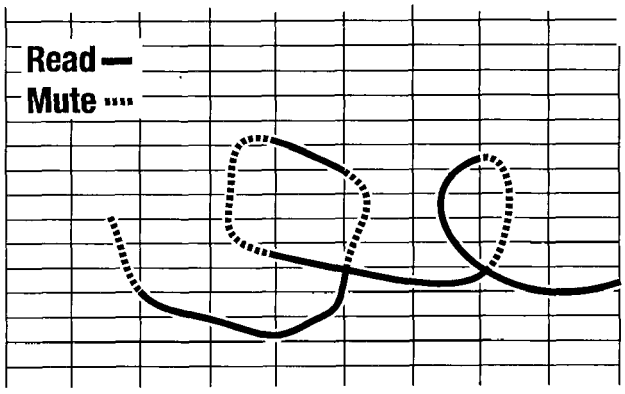

Rule 16) Read Path Clipped To Nearest Beat. As user draws paths back-and-forth on timeline, path can be clipped to most recent beat passed (FIG. 30).

Figure 31:
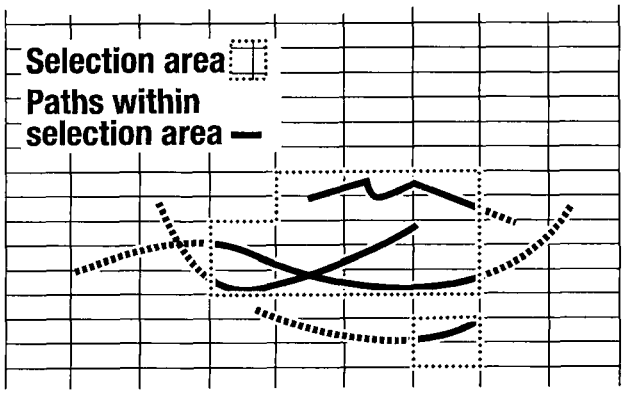

Rule 17) Read Only Paths Or Sections Of Paths As Selected By User (FIG. 31). Refer to path/path sections selection methods described previously in 1) Modification of paths.

A skilled reader will understand that the computer program of the present invention can be similar to a Bezier path-based computer drawing program, but for music.

Possible Implementations

The present invention, in one aspect thereof, may be implemented as a computer program. The computer program may be implemented as a tablet application, or mobile application or desktop application. Each of these may connect to the Internet to access computer network implemented resources through a server computer. For example the server computer may be used to access source files from an online library, store musical content to a cloud database, or to access collaborative features.

The system of the present invention may be implemented based on various centralized or decentralized architectures. The Internet or any other private or public network (for example a company's intranet) may be used as the network to communicate between the centralized servers and the various computing devices and distributed systems that interact with it.

The present invention may also be operable over a wireless infrastructure. Present wireless devices are often provided with web browsing capabilities, whether through WAP or traditional means.

As skilled reader will appreciate that numerous different implementations of the technology are possible.

The sound engine (10) may also be implemented in a collaborative fashion so as to enable two or more users to compose music together using collaborative music mapping GUIs.

In order to access to the sound engine (10), the operator of the web platform including the sound engine (10) may require users to subscribe to the platform. Various models may be used to monetize the platform including for example subscription fees, freemium models, or placement of advertising in web pages associated with the web platform.

It should be understood that the functionality described may be integrated with a range of different musical composition tools, whether by incorporating the computer program of the present invention into third party musical composition packages, or implementing the functionality described as a web service that is linked to third party musical composition platforms or services. The present invention is not limited to any particular implementation of, or use of, the technology described.

For example GarageBand™ may be enhanced by integrating the present invention as an additional mechanism for creating musical content. For example the system of the present invention may act as an input device to a variety of applications using a plugin, including GarageBand, but also Ableton Live, or Reason.

The present invention may also be implemented as a new sound source and thereby can work with and complement existing functionality, in effect adding a major new feature to various music related applications, and also enhancing user experience.

Indeed, the present invention may replace the current musical composition tools in a variety of platforms with a new, more flexible and easier to use functionality based on the present invention.

In addition, a studio application may incorporate the sound engine (10) of the present invention, for example to provide dynamic input/editing tools as part of the studio application.

Additionally, music DJ application such as Cross DJ™ may incorporate one or utilities or features based on the present invention. The ease of use and new sound palette provided by the present invention fits well with the experimental nature of DJ-ing.

Video gaming systems may include the sound engine (10) or link to a web platform incorporating the sound engine (10), for example enabling users to customize sounds for playing environments.

The sound engine of the present invention may be integrated with a learning utility (not shown). There is a growing body of scientific evidence that learning music significantly enhances the student's overall ability to learn. The system provides, in one aspect there, of an easy-to-use, intuitive notation system that enables dynamic feedback and experimentation that facilitates the learning and appreciation of music. With the sound engine there is no need to learn an instrument rather a user can begin to make music by drawing paths on the music composition interfaces. The student, using the computer program of the present invention, can create musical arrangements that are pleasing, and thereby learn basic compositional and harmonic concepts.

Advantages

Between the use of Bezier paths and the simplified music notation/interface the present invention embodies a distillation of music creation down to its essence, to a new medium. The methods of the present invention create an environment where music creation is a surprising combination of ease-of-use with unlimited expressiveness.

Numerous of the advantages of the invention have already been highlighted. Further advantages include:

The computer program of the present invention is easy to learn. The interface is very intuitive and simple because the grids visually and accurately represent pitch, volume and duration. This negates the need to learn the complex classical notation system that employs the use of sharps and flats to denote pitch, verbal descriptions that imply volume dynamics, and clef notes to define pitch and duration. It also negates the need to learn the complex workings or pre-existing music creation programs.

The present invention provides a strong dynamic experience.

For music composers, the invention provides the ability to work on a airplane using a laptop or tablet and sketch out musical ideas.

The invention provides the ability to imitate a range of different conventional instruments, and in effect provides a mobile orchestra (for laptops and tablets) at a musician's fingertips.

The invention provides precise control over notes. It provides a palette with an infinite range of pitch/volume/duration possibilities. The interfaces of the present invention provide precise control over notes, and the ability to create, modify and generate previously inexpressible pitch and volume combinations, allowing for the exploration of new sounds.

There are cost advantages to the present invention as there is no need to hire musicians to input notes.

The invention provides precise communication between composers and musicians as composers can actually let musicians hear exactly how they want notes played.

The invention provides a tool for learning an instrument. A person learning the sax, for example, could use the invention to explore new combinations of sax pitch and volume, thereby raising the 'bar' for their skill level and improving their dexterity on the instrument.

In gaming systems the present invention provides the ability to integrate user customization of sound elements of games.

The present invention provides an engaging experience for music lovers, giving them the ability to participate in music composition with little initial knowledge being required.

The present invention provides a strong platform for music-based therapy. Its ease of use allowed allows children to doodle tunes to express their feelings. The technology described provides an innovative way to engage, for example, children on the non-verbal end of the autism spectrum.

The present invention makes it easy for users to sync and manipulate music files, creating derivative works. This would enable collaborative creation by multiple composers.

Further Implementations

It will be appreciated by those skilled in the art that other variations of the embodiments described herein may also be practiced without departing from the scope of the invention. Other modifications are therefore possible. It should be understood that the present invention may be implemented in a number of different ways, using different collaborative technologies, data frameworks, mobile technologies, web presentment technologies, content enhancement tools, document summarization tools, translation techniques and technologies, semantic tools, data modeling tools, communication technologies, web technologies, and so on. The present technology could also be integrated into one or more of such third party technologies, or such third party technologies could be modified to include the functionality described in this invention.

Several embodiments are specifically illustrated and/or described herein. However, it will be appreciated that modifications and variations are covered by the above teachings and within the scope of the appended claims without departing from the spirit and intended scope thereof. Various embodiments of the invention include logic stored on computer readable media, the logic configured to perform methods of the invention.

The embodiments discussed herein are illustrative of the present invention. As these embodiments of the present invention are described with reference to illustrations, various modifications or adaptations of the methods and or specific structures described may become apparent to those skilled in the art. All such modifications, adaptations, or variations that rely upon the teachings of the present invention, and through which these teachings have advanced the art, are considered to be within the spirit and scope of the present invention. Hence, these descriptions and drawings should not be considered in a limiting sense, as it is understood that the present invention is in no way limited to only the embodiments illustrated.

The invention claimed is:

1. A system for generating, controlling or modifying sound entities, comprising:

one or more computer processors configured to provide a sound processing utility for generating, controlling or modifying sound entities, the sound processing utility linked to one or more computers, or accessible by the one or more computers, the sound processing utility presenting, or initiating the presentation, on a display connected to the one or more computers, of one or more graphical user interfaces for music composition or modification that enable a graphical map of one or more musical elements as parametric representations thereof, wherein the parametric representations are encoded with information elements corresponding to the musical elements, wherein the parametric representations and the encoded information elements can both be defined or modified by the graphical user interface so as to enable the generation, control, or modification of the sound entities, the musical elements comprising pitch, volume, and duration of notes, and the parametric representations defined using Bezier paths.

2. The system of claim 1, wherein the parametric representations comprise parametric curves that define a path of curves.

3. The system of claim 1, further comprising one or more audio processing components operable to play the sound entities.

4. The system of claim 3, wherein the parametric representations encapsulate information for displaying a path on the interface, and also encapsulate the information for playing the sound entities, and wherein the parametric representations are modifiable based on user input to the interface such that modifications to the parametric representations make corresponding changes to the information for playing the sound entities.

5. The system of claim 1, wherein the parametric representations are generated using one or more processes that create scalable parametric paths, such that the encoding of the parametric representations with the information elements is scalable.

6. The system of claim 1 wherein the sound processing utility creates calculation points for a parametric representation corresponding to the musical elements into a Bezier path, stores the path, and if input is received from the interface to modify the parametric representation, more calculation points are added to the Bezier path corresponding to such input, thereby enabling the modification of the sound entities such that smooth transitions are audible when the sound entities are played using an audio processing component.

7. The system of claim 1, wherein the graphical user interface provides a music composition tool.

8. The system of claim 7, wherein the interface includes one or more grids, each grid including a timeline, and receiving input at the interface to create parametric representations and placing them in the timeline so as to construct a musical composition.

9. The system of claim 8, the one or more grids include a pitch grid, wherein the pitch grid that is executable to allow one or more users to draw on the pitch grid one or more paths corresponding to a note and any pitch between any notes so as to create a spatial representation of pitch attributes of sound elements that correspond to an associated pitch frequency spectrum.

10. The system of claim 9, wherein the length of the path defines the duration of a note.

11. The system as claim 9, wherein the one or more grids further include a volume manipulation grid that is synchronized with the pitch grid such that input to the pitch grid and the volume grid in aggregate enables modulation of the musical elements.

12. A computer implemented method for generating, controlling, or modifying sound entities comprising:

displaying one or more music composition/modification graphical user interfaces implemented to one or more computers including or being linked to a touch screen display;

receiving one or more selections relevant to one or more musical elements using the interface, the musical elements comprising pitch, volume, and duration of notes;

generating one or more parametric paths corresponding to the selections and encoding the musical elements, the parametric paths defined using Bezier paths; and storing the parametric paths so as to define one or more executable sound entities, wherein the sound entities can be defined or modified using the graphical user interface so as to enable the generation, control, or modification of the sound entities.

13. A computer implemented method for generating, controlling, or modifying sound entities comprising:

displaying one or more music composition/modification graphical user interfaces implemented to one or more computers including or being linked to a touch screen display, wherein the interface includes one or more grids, a first grid for selecting pitch attributes, and a second grid for selecting volume attributes;

receiving one or more selections relevant to one or more musical elements using the interface;

generating one or more parametric paths corresponding to the selections and encoding the musical elements; and storing the parametric paths so as to define one or more executable sound entities, wherein the sound entities can be defined or modified using the graphical user interface so as to enable the generation, control, or modification of the sound entities accessing, including iteratively, the first grid and the second grid, so as to define or modify pitch attributes and volume attributes for the one or more sound entities;

receiving input using the graphical user interface that the definition or modification of the pitch attributes and the volume attributes have been completed; and storing the one or more sound entities defined by the selection of the pitch attributes and volume attributes to a data store, thereby providing the one or more executable sound entities based on such pitch attributes and sound attributes.

14. The method of claim 12, further comprising: playing the one or more sound entities, wherein the parametric paths encapsulate information for playing the sound entities.

15. The method of claim 12, further comprising displaying the parametric path on the interface, and wherein the parametric paths are modifiable based on input at the interface such that modifications to the parametric paths make corresponding changes to the information for playing the sound entities.

16. The method of claim 13, further comprising: playing the one or more sound entities, wherein the parametric paths encapsulate information for playing the sound entities.

17. The method of claim 13, further comprising displaying the parametric path on the interface, and wherein the parametric paths are modifiable based on input at the interface such that modifications to the parametric paths make corresponding changes to the information for playing the sound entities.

18. The method of claim 12, wherein the interface includes one or more grids, each grid comprising a timeline, and the method further comprises receiving input at the interface to create the parametric paths and placing them in the timeline so as to construct a musical composition.

19. The method of claim 13, wherein each grid comprises a timeline, and the method further comprises receiving input at the interface to create the parametric paths and placing them in the timeline so as to construct a musical composition.

20. The method of claim 12, wherein the length of the parametric path defines the duration of a note.

* * * * *